US008196229B1

(12) United States Patent
Hickok

(10) Patent No.: US 8,196,229 B1
(45) **Date of Patent: *Jun. 12, 2012**

(54) ADJUSTABLE FLOOR DRAIN

(76) Inventor: Richard F. Hickok, Buchanan, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/212,238

(22) Filed: Aug. 18, 2011

Related U.S. Application Data

(63) Continuation-in-part of application No. 12/136,307, filed on Jun. 10, 2008, which is a continuation-in-part of application No. 11/828,015, filed on Jul. 25, 2007, now abandoned.

(51) Int. Cl.
*E03C 1/26* (2006.01)

(52) U.S. Cl. ..... 4/288

(58) Field of Classification Search ..... 4/286–295
See application file for complete search history.

(56) References Cited

U.S. PATENT DOCUMENTS

| | | | | |
|---|---|---|---|---|
| 1,959,171 | A | 5/1934 | Mayer | |
| 2,593,918 | A | 4/1952 | Redman | |
| 2,749,999 | A | 6/1956 | Schmid | |
| 2,859,452 | A * | 11/1958 | Seewack | 210/165 |
| 3,392,844 | A * | 7/1968 | Decarie | 210/463 |
| 3,438,066 | A | 4/1969 | Morris | |
| 4,827,539 | A | 5/1989 | Kiziah | |
| 4,883,590 | A | 11/1989 | Papp | |
| 4,976,568 | A | 12/1990 | Hess | |
| 5,878,448 | A | 3/1999 | Molter | |
| 5,996,612 | A | 12/1999 | Crawford | |
| 6,085,362 | A | 7/2000 | Huber | |
| 6,209,586 | B1 | 4/2001 | Wright | |
| 6,224,292 | B1 | 5/2001 | Akalin | |
| 6,350,373 | B1 | 2/2002 | Sondrup | |
| 6,453,482 | B1 * | 9/2002 | Mullings | 4/507 |
| 6,886,190 | B2 | 5/2005 | Tompane | |
| 7,458,108 | B2 * | 12/2008 | Wolf | 4/222.1 |
| 2005/0150040 | A1 | 7/2005 | Barber | |
| 2005/0279697 | A1 | 12/2005 | Stephenson et al. | |

* cited by examiner

*Primary Examiner* — Lori Baker
(74) *Attorney, Agent, or Firm* — Botkin & Hall, LLP

(57) ABSTRACT

An adjustable floor drain includes an adapter plate securable to a base imbedded within flooring. A locator ring overlays the adapter plate and the combined thicknesses of the locator ring and adapter plate are at least equal to the thickness of a covering over the floor. A grid plate overlays the adapter plate and is seated within the locator ring. The locator ring and adapter plate may be integrally formed as a single unit, and a frame member frames the drain to provide a neat, finished appearance.

16 Claims, 8 Drawing Sheets

ADJUSTABLE FLOOR DRAIN

CROSS REFERENCE TO RELATED APPLICATIONS

This application is a continuation-in-part of U.S. application Ser. No. 12/136,307, filed Jun. 10, 2008, which is a continuation-in-part of U.S. application Ser. No. 11/828,015, filed Jul. 25, 2007 now abandoned, the disclosures of which are hereby incorporated by reference.

BACKGROUND OF THE INVENTION

This invention relates to a floor drain or strainer which allows for the adjustment of the height of the drain grid or grate.

For normal plumbing construction it is common to imbed the base of the drain in the concrete which forms the floor for the drain. Attached to the upper surface of the base is a grate held by two or three screws which extend through the grate and into the base. Commonly, the diameter of the base which accommodates the grate may vary from 1½ to 5 inches. The top of the drain body and the grate are usually flush with the upper surface of the flooring. During renovation, it is very common to recover the upper surface of the flooring with tile, linoleum, or wood. This causes the grate of the existing drain to be recessed with a resulting lip formed about the tile or floor covering next to the grate.

SUMMARY OF THE INVENTION

In this invention the floor drain is provided with component parts by which the grate can be raised above the existing base so as to be located substantially flush with the new floor covering. This is accomplished by an adapter plate which fits upon and is attached to the underlying base. A locator ring is then secured to the adapter plate all within the recessed area defined by the floor covering. The grate is then seated within the locator ring and is secured by its fasteners to the underlying adapter plate. The thickness of the adapter plate and locator ring approximates the thickness of the tile, wooden covering or linoleum applied over the original flooring so that the grate when attached to the adapter plate within the locator ring is substantially flush with the upper surface of the floor covering. The adapter plate is shaped such that it is compatible for being fastened to bases having varying diameters and screw configurations.

In another aspect, the adapter plate and the locator ring may be integrally formed to define a single unit. A frame member for framing the drain is also provided. The frame member includes an opening and a top surface. The top surface of the frame member is substantially level with the upper surface of the covering and the grid plate when the grid plate and the locator ring are in the frame member opening.

Accordingly, it is an object of this invention to provide an adjustable floor drain in which the grate of the drain can be raised to the level of the new floor covering.

Another object of this invention is to provide an adjustable floor drain which is of economical construction and of simple installation.

A further object of the invention is to provide an adjustable drain which includes an adapter plate suitable for fastening to bases having varying diameters and screw configurations.

Other objects of this invention will become apparent upon a reading of the following description.

DESCRIPTION OF THE PREFERRED EMBODIMENT

Figure 1:
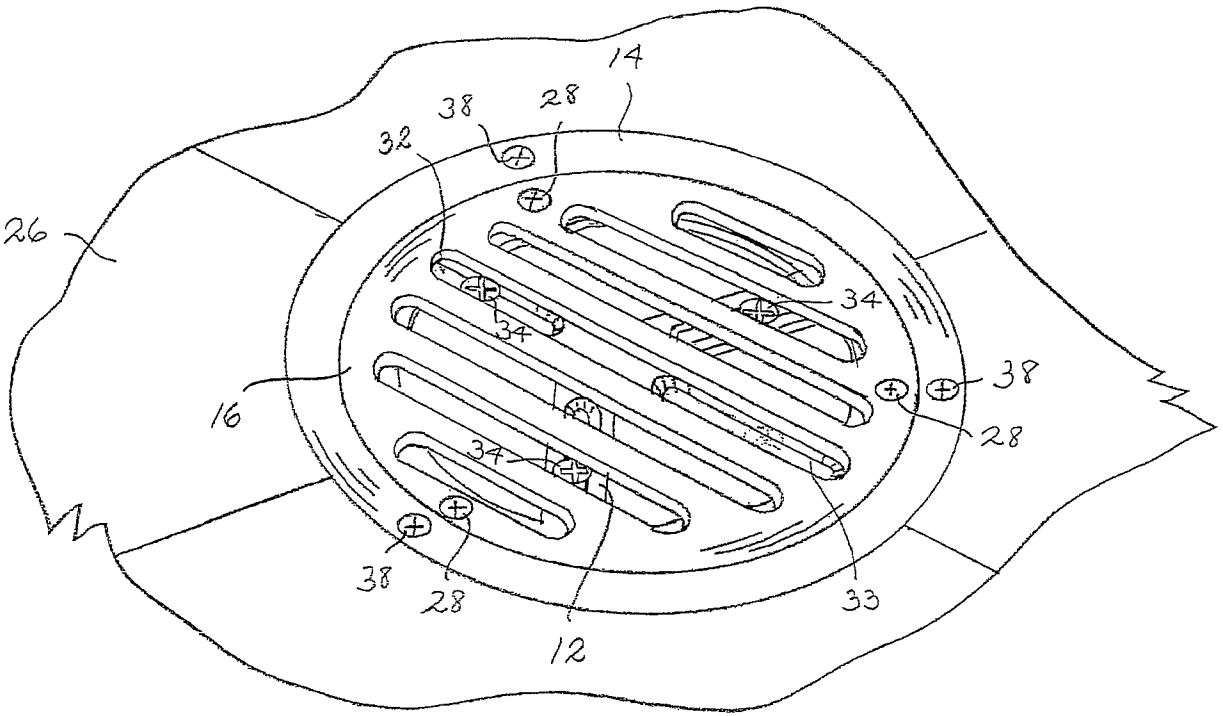
FIG. 1 is a perspective view showing the adjustable floor drain installed.
Figure 2:
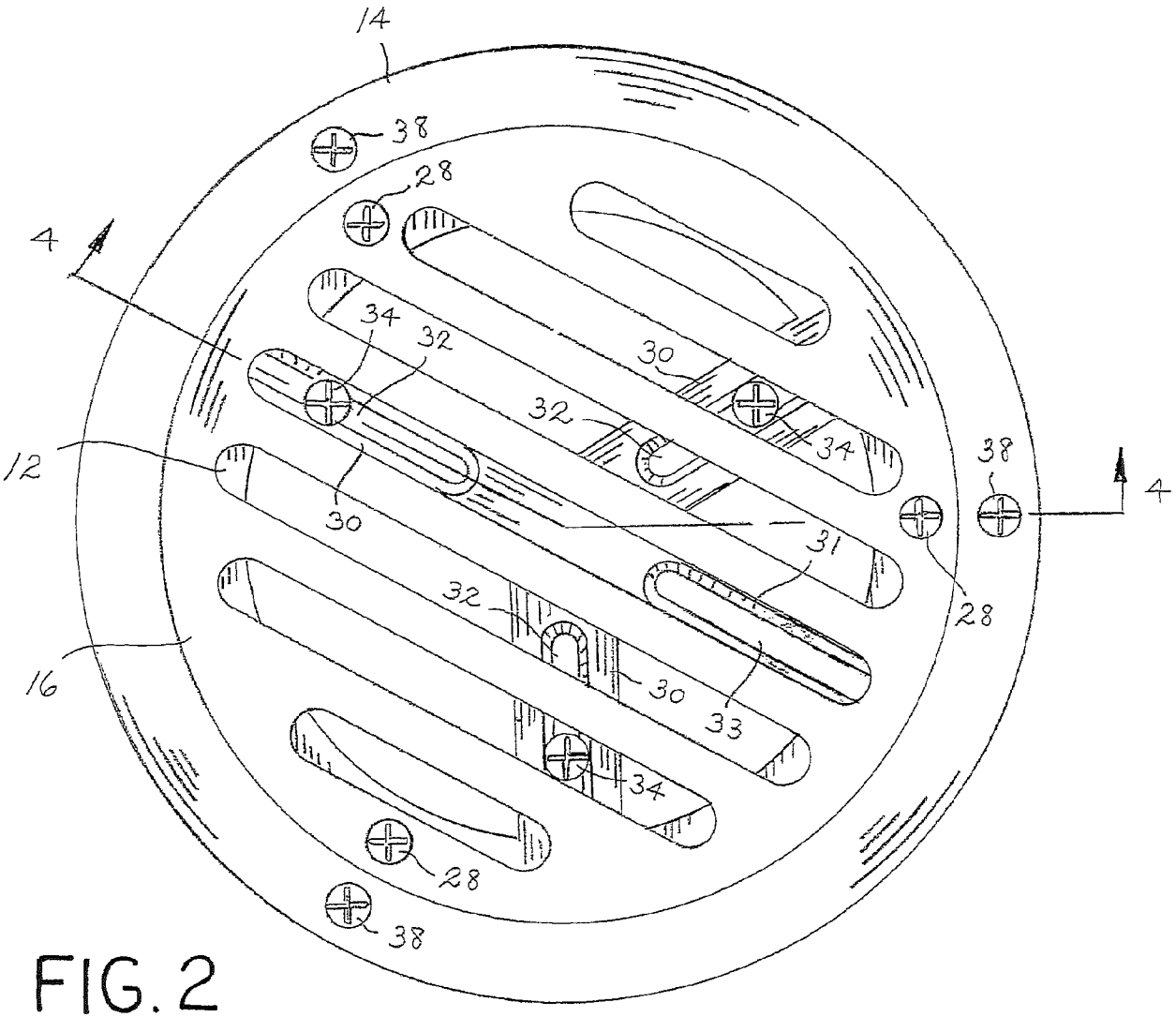
FIG. 2 is a top plan view of the installed adjustable floor drain.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 3:
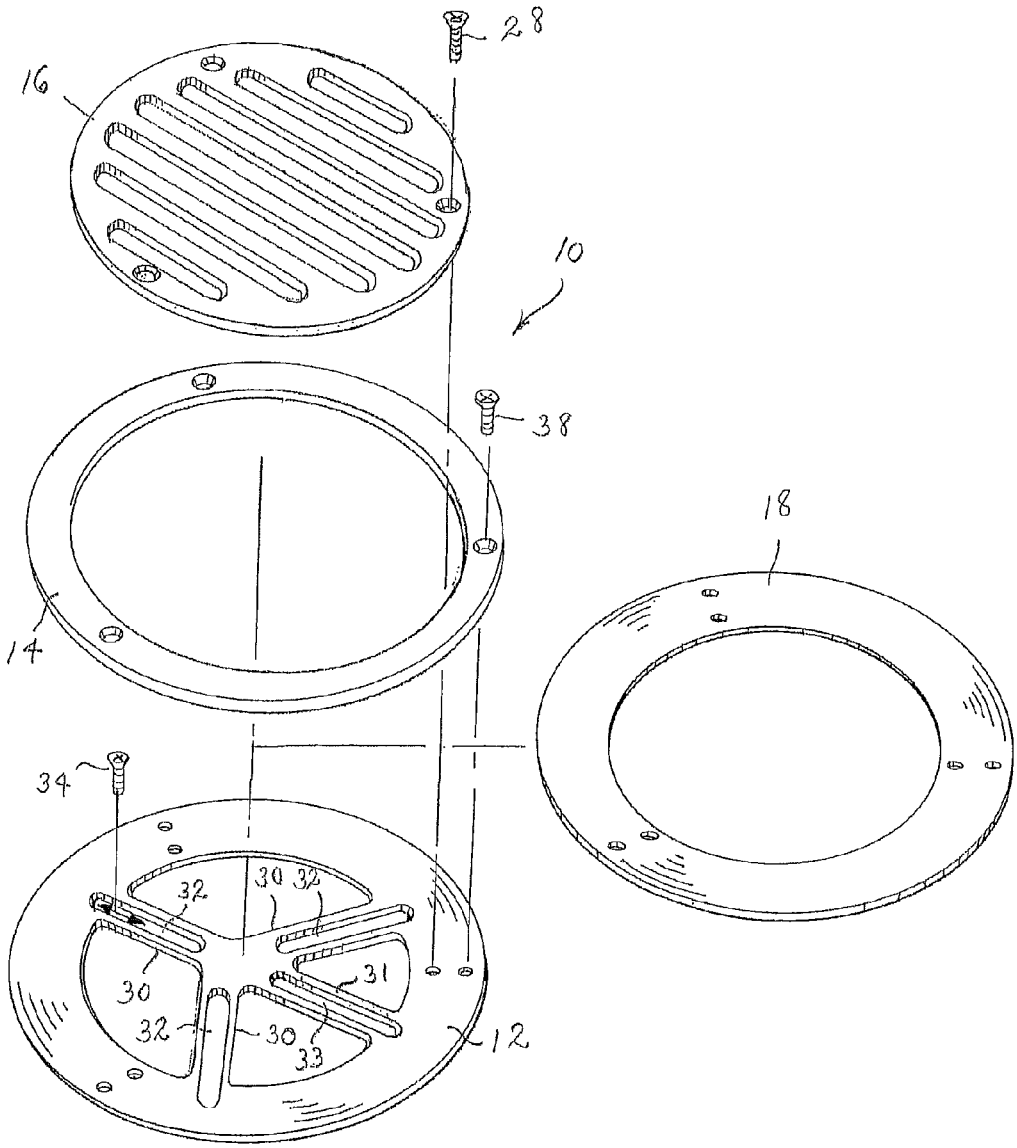
FIG. 3 is an exploded perspective view of the components for the adjustable floor drain.
Figure 7:
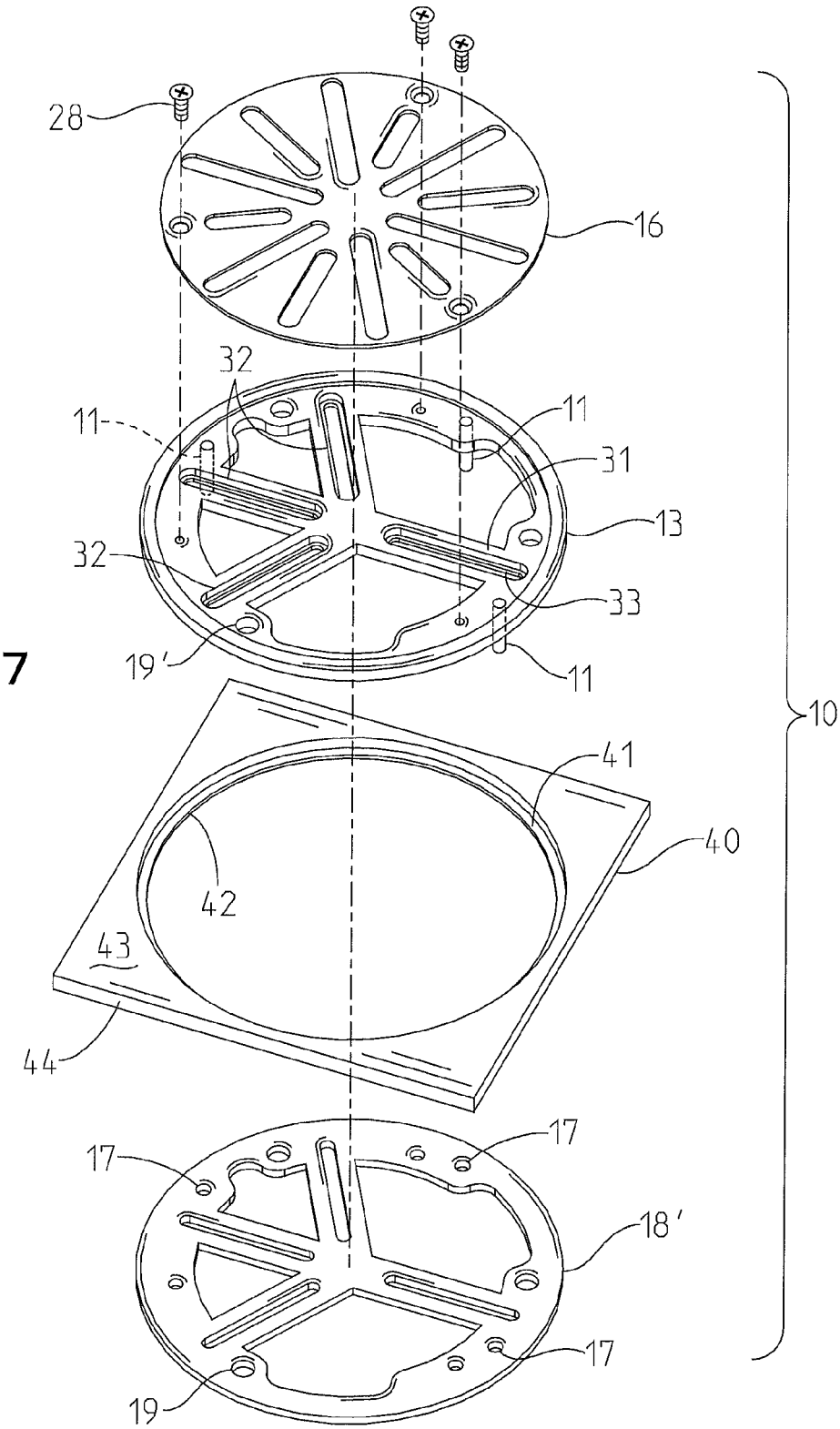
FIG. 7 is an exploded perspective view of an embodiment of the drain assembly of the invention showing the single unit and frame member.

Referring to FIGS. 3 and 7, the component parts of the adjustable floor drain 10 of this invention include the adapter plate 12, locator ring 14 and grid plate or grate 16. In one embodiment, the adapter plate 12 and locator ring 14 are integrally formed to define a single unit 13, as shown in FIG. 7. In that embodiment, single unit 13 includes mortar bores 19' and downwardly extending posts 11. To allow for various thicknesses of the floor covering, a spacer ring 18, 18' is provided. The spacer ring 18' may include mortar bores 19 and holes 17 formed therein. A frame member 40 may also be provided for framing the assembly against the flooring. The frame member 40 is preferably polygonal in shape.

Figure 4:
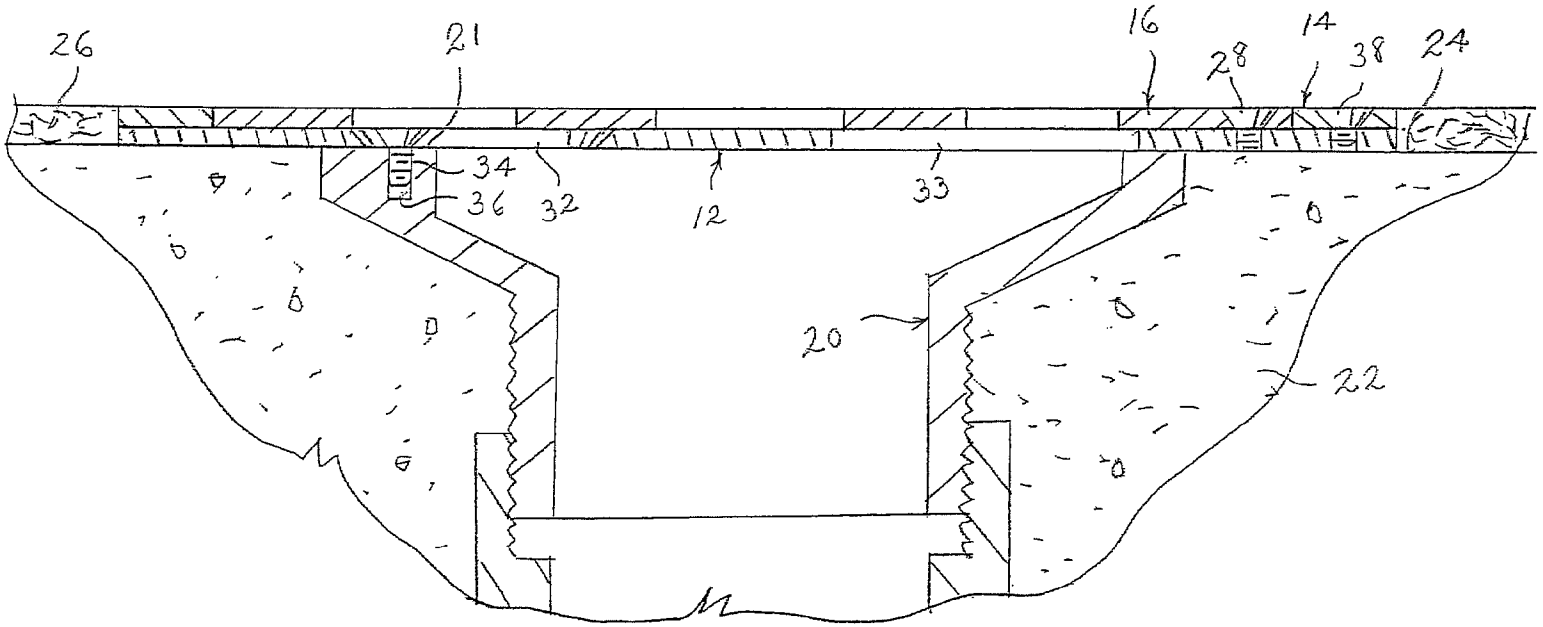
FIG. 4 is a sectional view of the adjustable floor drain installed.
Figure 8:
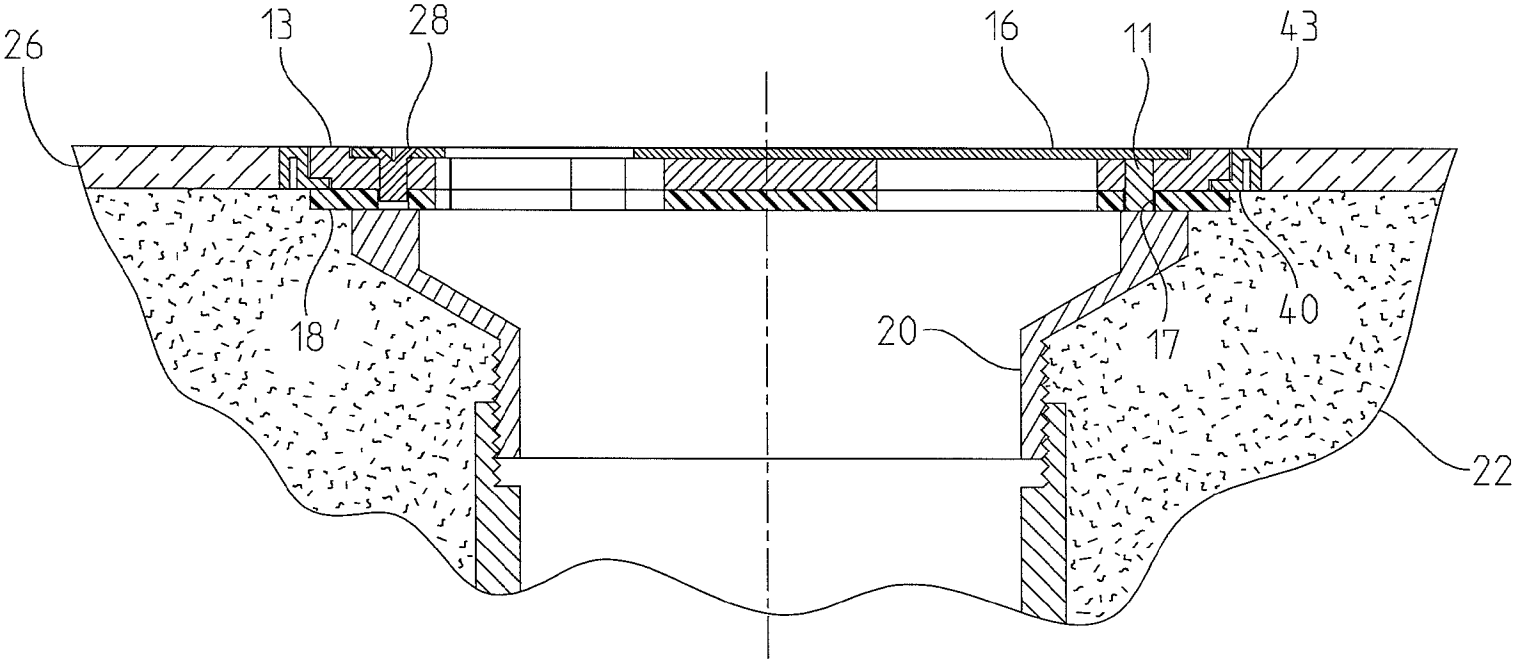
FIG. 8 is a cross-sectional view of the drain assembly taken along line 8-8 of FIG. 6.

As best illustrated in FIGS. 4 and 8, the drain base 20 is shown imbedded in flooring 22 which is normally of a concrete construction. Base 20 is shown in two part form so as to allow for the adjustment of the top of the base relative to the upper surface 24 of the flooring 22 when the flooring is laid and the base originally set in the floor. In other constructions base 20 may be a one piece form.

Figure 6:
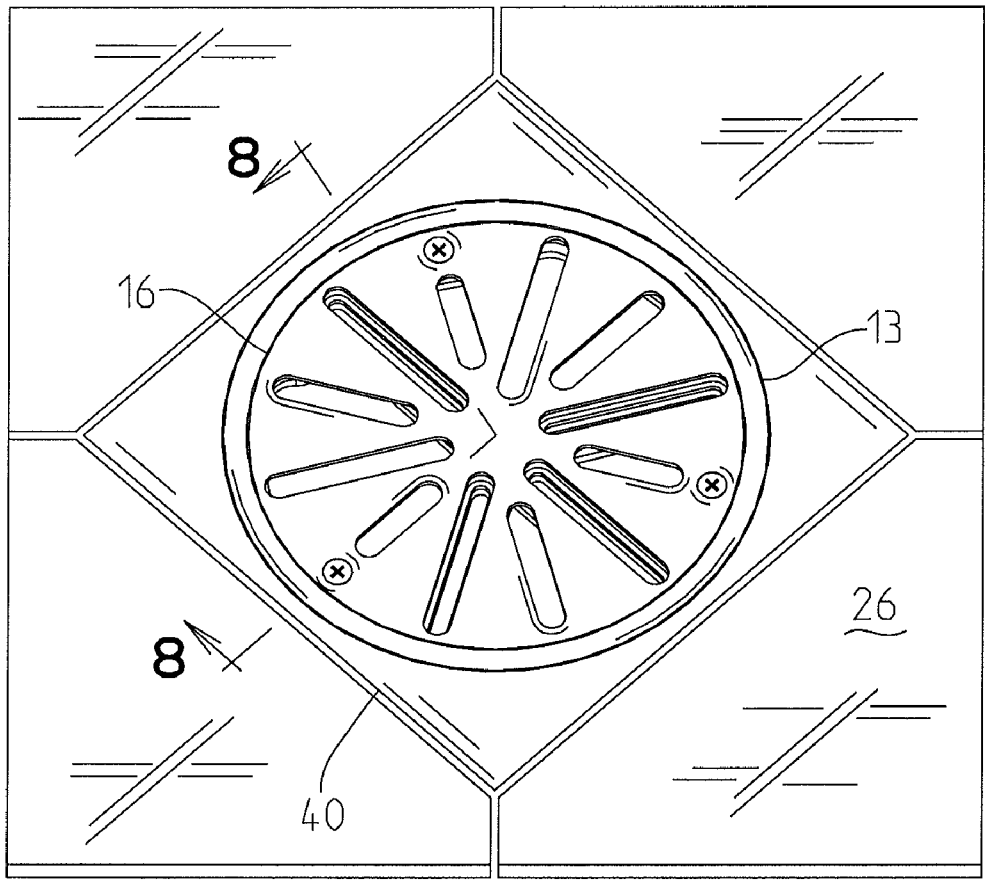
FIG. 6 is a perspective view of the adjustable floor drain installed showing the frame member against a tile floor.

With particular reference to FIGS. 6-8, wherein the adapter plate and the locator ring are integrally formed to define a single unit 13, the frame member 40, single unit 13 and grid plate 16 are first preliminarily assembled together and positioned above the base 20. This enables the height adjustment necessary to approximate the thickness of the covering extending over the flooring 26 to be taken. This may apply especially in tile applications, for which the frame member is especially well suited. Once done, mortar (or cement) may be used in some applications, if desirable, to more permanently set the assembly in place. In those applications, mortar holes 19' are provided in the single unit 13 enabling mortar or cement beneath the assembly 10 to penetrate and hold the assembly in place.

With grid plate 16 removed, adapter plate 12 or single unit 13 are placed over the upper surface 21 of base 20. Adapter plate 12 is provided with an open center interrupted by a plurality of equal-angularly spaced, radially extending arms 30, as best shown in FIG. 3. Similarly, single unit 13 is provided with an open center interrupted by a plurality of equal-angularly spaced, radially extending arms 31 as best shown in FIG. 3. Each arm 30, 31 has an elongated slot 32 formed in it. There is an additional arm 31 provided with adapter plate 12 and which is aligned with one of the arms 30. A slot 33 is formed in arm 31. Slots 32, 33 are likewise formed in single unit 13 and receive screws 34 which are turned into the accommodating threaded bores 36 in base 20, which were originally utilized to secure the original grid plate 16 in place.

Slots 32, as shown in FIG. 8, are arranged to accommodate various sized bases 20 as well as whether the original grid plate 16 was secured to the base by three equal angularly spaced screws in which case slots 32 would be utilized or two diametrically located screws in which case slot 33 and its aligned slot 32 would be utilized since they are 180° apart. In this manner adapter plate 12, or single unit 13, has a universal fit for various sized bases and screw locations and may be formed of any suitable rigid material, such as plastic, steel, aluminum, or brass.

Referring to FIGS. 1-5, once adapter plate 12 has been secured to the upper surface 21 of base 20 by screws 34, locator ring 14 will then be placed over the upper surface of the adapter plate and secured thereto by screws 38. Three screws 38 are preferably used to secure the locator plate 14 to the adapter plate 12. The combined thickness of the adapter plate and locator plate is substantially the same thickness as covering 26 so that a flush upper surface between the locator plate and covering is provided. Once the locator ring 14 has been secured to the adapter plate 12, grid plate 16 is seated within the locator ring and preferably secured to the adapter plate by screws 28. Grid plate 16 rests upon adapter plate 12 and has a thickness that is equal or substantially equal to the thickness of locator ring 14 so that the upper face of grid plate 16 is flush with the upper surface of covering 26 over flooring 22. Locator ring 14 and grid plate 16 may be formed of steel, brass, aluminum or plastic and will generally range from $1/16^{th}$ inch to $1/8^{th}$ inch thick.

Figure 5:
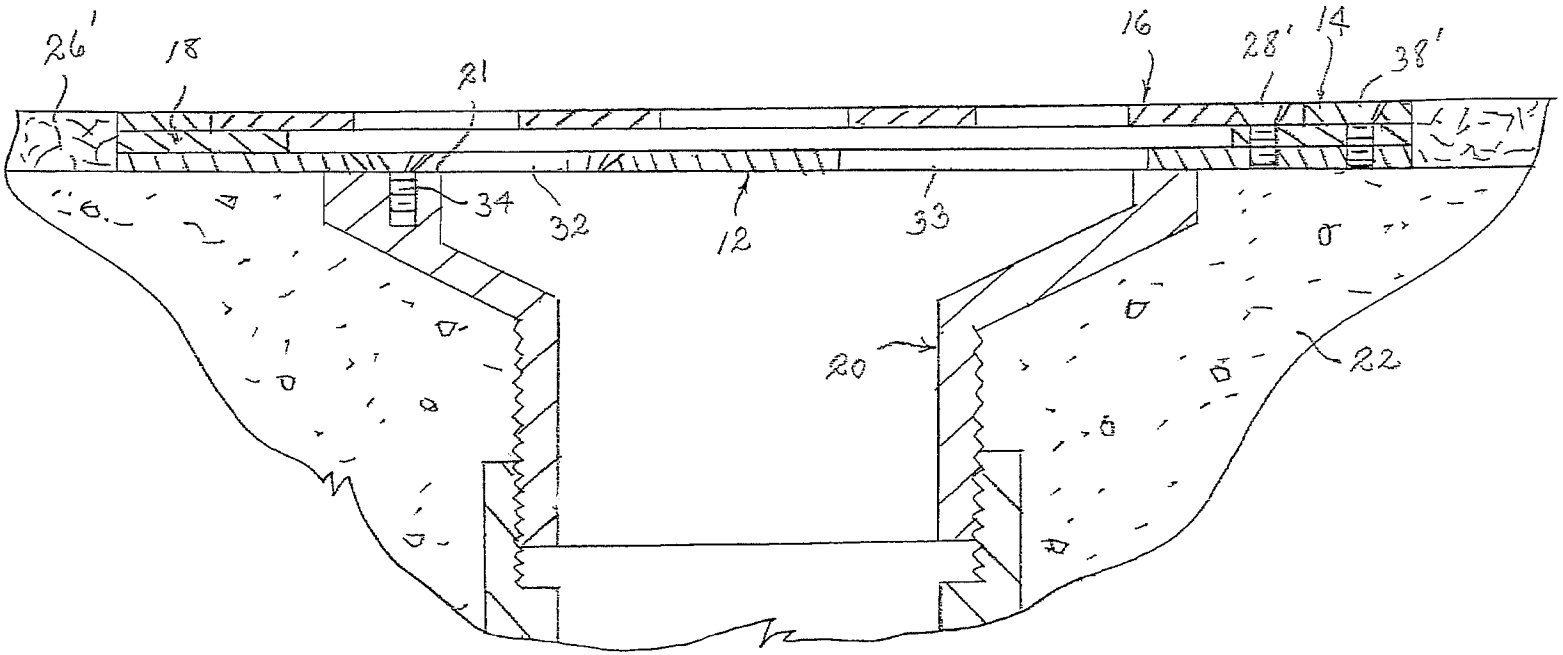
FIG. 5 is a section view of the adjustable floor drain showing the adjustable drain being installed and the utilization of a spacer ring to accommodate a thicker floor covering.

Should the covering 26' over floor 22 be exceptionally thick, it may be necessary to provide a spacer 18, 18' to provide added thickness for the floor drain. As shown in FIG. 3, and as depicted in FIG. 5, spacer 18 overlies the upper face of adapter plate 12 and is secured to the adapter plate by elongated screws 38' which extend through locator ring 14, the spacer ring 18 and are turned into threaded bores in the adapter plate 12. In the embodiment of FIG. 7, spacer 18' includes holes 17 for receiving the posts 11 extending downward from the underneath surface of the single unit 13 thus enabling mortar holes 19' in the single unit to align with mortar holes in the spacer(s) 18', which permits mortar (or cement) to penetrate the assembly and more permanently set it in place.

With spacer ring(s) 18 in place locator ring is secured over the spacer ring as shown in FIG. 5, the grid plate 16 can be placed within the locator ring and seated upon the upper surface of spacer ring 18. Screws 28' extend through grid plate 16, spacer ring 18 are turned into threaded bores in adapter plate 12 to preferably secure the grid plate to the spacer ring and adapter plate. In the alternative embodiment shown in FIGS. 6-8, the grid plate 16 and the single unit 13 are seated in the frame member 40, and this assembly is positioned in place upon spacer(s) 18' and mortar/cement, if desired, fine adjustments are made to square the frame member 40 with the cut edges of the tile and screws 28 installed as adapter plate 12 is rotatable relative the frame member. In both cases, through the use of spacer ring 18, 18' the combined thickness of adapter plate 12, spacer ring 18 and locator ring 14 can be made to closely approximate the thickness of covering 26' extending over flooring 22. Additionally such as, in the case of tile applications, frame member 40 also provides a clean linear appearance and its polygonal shape eases tile installation by eliminating non-linear tile cuts leaving a neat, finished appearance around the drain. Like locator ring 14 and grid plate 16, spacer ring 18, 18' and frame member 40 may be formed of plastic, steel, aluminum or brass.

To assemble the adjustable floor drain 10 (as depicted in FIG. 3) on base 20, locater ring 14 is rested upon adapter plate 12. One or more spacer rings 18 are sandwiched between adapter plate 12 and locator ring 14, to adjust the distance between the adapter plate and the locater ring. The adapter plate, locator ring, and spacer ring (if any) are fastened together with screws 38. One or more screws 34 secure the adapter plate to base 20, with the screws anchored to base 20 and slots 32, 33, with the radial position of the screws in the slots varying based on the diameter of the base. Grid plate 16 rests upon adapter plate 12 or spacer ring 18, if present. Grid plate 16 is fastened with screws 28 to adapter plate 12 or spacer ring 18, if present.

To assemble the adjustable floor drain 10 (as depicted in FIG. 7) on base 20, single unit 13 is seated in a stepped recess 41 of frame 40. Single unit 40 is rotatable relative to frame 40. One or more spacers 18' may be positioned below single unit 13 with posts 11 nested in holes 17 so as to align the spacer and adapter plate slots 32, 33. Stepped recess 41 of frame 40 is thereby sandwiched between single unit 13 and spacer(s) 18'. One or more screws secure the single unit/frame/spacer combination to base 20, with the screws anchored to base 20 through slots 32, 33, with the radial position of the screws in the slots varying based on the diameter of the base. Frame 40 may be rotated relative to single unit 13 and spacer(s) 18' during installation to align frame 40 with a floor covering such as tile. Grid plate 16 is fastened with screws 28 to single unit 13.

While the invention has been illustrated and described in detail in the drawings and foregoing description, the same is to be considered illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A floor drain comprising:

a tubular strainer base anchored in a floor, said base having an upper face;

an adapter plate resting upon said base upper face, said adapter plate having an outer edge and a center member, at least one radially extending arm joining said center and said outer edge, a radially extending slot is formed through said arm, a fastener extending through said slot to anchor said adapter plate to said base;

a locator ring overlying said adapter plate;

a grid plate overlying said adapter plate and seated within said locator ring.

2. The drain of claim 1 and a spacer ring sandwiched between said adapter plate and said locator ring, said spacer ring a ring-shaped plate having an outer edge and an open center.

3. The drain of claim 2 wherein said grid plate rests upon said spacer ring.

4. The drain of claim 1 wherein said grid plate rests upon said adapter plate.

5. The drain of claim 1 wherein said adapter plate includes a plurality of said radially extending anus, said arms angularly spaced about said center each of said arms having a longitudinally extending slot formed therethrough.

6. The drain of claim 5, wherein at least two of said slots accept a fastener extending into said base to anchor said adapter plate to said base.

7. The drain of claim 6, wherein each said fastener is radially slidable within said slot to accommodate fastening said adapter plate to said base of varying diameter.

8. The drain of claim 6 wherein said adapter plate has another radially extending arm diametrically aligned with one of said arms, said another arm having a slot formed therethrough accommodating a fastener anchoring said adapter plate to said base.

9. The drain of claim 8, wherein each said fastener is radially slidable within said slot to accommodate fastening said adapter plate to said base of varying diameter.

10. An adapter plate for adjustably mounting a grid plate to the upper face of a tubular strainer base, said adapter plate comprising:

a disc member having an outer edge and a center member, a radially extending arm joining said center member and said outer edge, a radially extending slot formed through said arm and extending between said center member and said outer edge, wherein said disc member has a top surface and a bottom surface, a lip extending from said top surface at said outer edge of said disc member, said grid plate resting upon said adapter plate and within said lip, said lip having a top edge, said grid plate having an upper surface, said top edge of said lip and upper surface of said grid plate being substantially flush.

11. The adapter plate of claim 10, and a post extending from said bottom surface of said outer edge of said disc member, and a spacer ring having an outer edge with an aperture passing therethrough, said aperture accepting said post.

12. The adapter plate of claim 10, wherein said disc member has an upper face, said arm having an edge forming a perimeter around said slot and substantially flush with said upper face, said slot including a ledge recessed from said upper face for accepting a fastener.

13. The adapter plate of claim 10, wherein said disc member includes three of said arms equi-angularly spaced about said center, and said disc member includes a fourth arm diametrically aligned with one of said three arms.

14. The adapter plate of claim 10, and a frame having an opening and a top surface, and a ledge inwardly extending from said opening for carrying said disc member.

15. The adapter plate of claim 14, wherein said frame is rotatable relative said disc member whereby said frame is oriented relative a floor covering.

16. The adapter plate of claim 14, wherein said ledge is sandwiched between said disc member and a spacer ring.

* * * * *